US005287777A

United States Patent [19]

Kolodziej

[11] Patent Number: 5,287,777

[45] Date of Patent: Feb. 22, 1994

[54] RATCHETING OPEN END WRENCH

[76] Inventor: Edward Kolodziej, 5445 S. Alameda, Corpus Christi, Tex. 78412

[21] Appl. No.: 970,560

[22] Filed: Nov. 3, 1992

[51] Int. Cl.[5] ..... B25B 13/12

[52] U.S. Cl. ..... 81/179; 81/139

[58] Field of Search ..... 81/129, 139, 179

[56] References Cited

U.S. PATENT DOCUMENTS 2,797,600 7/1957 Beaver ..... 81/179

3,892,150 7/1975 Horton ..... 81/179

*Primary Examiner*—James G. Smith

*Attorney, Agent, or Firm*—John R. Benefiel

[57] ABSTRACT

An open end wrench has a single movable jaw to enable a ratcheting action. The movable jaw has an arcuate stem guided in an arcuate slot in the wrench body to enable spring retraction of the movable jaw to allow rotation of the jaws past the corners of a hex fastener in the reverse motion of the wrench. The center of the arcuate slot walls is located well within a quadrant of the wrench space nearest the slot which produces a particularly smooth ratcheting action enabling snapping the wrench over the bolt or nut from any angle. The movable jaw stem immediately wedges in the slot during advancing motion of the wrench to enable wrenching forces to be applied. Vee notches in the jaw faces allow twelve increments of ratcheting action, with a slightly shallower side on each notch further facilitating the ratcheting action. A serrating of the jaw faces enables the wrench to be used as an open end pipe wrench.

15 Claims, 3 Drawing Sheets

RATCHETING OPEN END WRENCH

BACKGROUND OF THE INVENTION

This invention concerns wrenches and more particularly ratcheting type wrenches enabling turning of a bolt, nut, or other threaded element without having to repeatedly reengage the wrench.

Socket type ratchets have long been employed but those require considerable end clearance, as the socket projects axially from the head of the ratchet drive. Sometimes, a bolt head or nut to be wrenched is in a location where sufficient end clearance is not available.

Open end wrenches must then be resorted to, but this requires a tedious successive removal and reengagement of the wrench jaws with the bolt head or nut.

Conventional pipe wrenches require a clearance on opposite sides of the pipe or fitting. Conventional open end wrenches are not effective to engage the pipe surface sufficiently tightly to set up a gripping action to loosen or tighten the pipe or fitting when the wrench is turned.

Ratcheting open end wrenches have previously been devised as for example disclosed in French patent 1,382,457, German DT 2041855, and U.S. Pat. No. 4,158,975. However, such prior open end wrenches have in some instances been complex, requiring multiple movable jaws. Ease of ratcheting has not been achieved in the prior designs, as the mechanism allowing movement of one or more jaws have not produced a smooth and easy operation.

The ease of ratcheting is important as allowing ratcheting past a loose nut or bolt. Also, the wrench can be snapped in place easily over the bolt head from any angle if the movable jaw is easily and smoothly retractable.

It is the object of the present invention to provide an open end wrench with a ratcheting action which is easier and smoother than prior designs, and simpler than the double jaw designs.

SUMMARY OF THE INVENTION

The present invention provides a ratcheting type open end wrench by a very simple arrangement, in which a fixed jaw and an opposing movable jaw are mounted on a wrench body. The movable jaw has an arcuate stem which fits into an arcuate slot formed in the wrench body, so that the movable jaw is guided for rotational movement as the stem moves in and out in the slot. A spring in a recess in the wrench body urges the stem outwardly from the slot to position the movable jaw face properly with respect to the fixed jaw face to define a properly sized wrench opening.

Upon rotation of the wrench body in one direction, i.e., in a direction towards the movable jaw and tending to push the hex shape contour of a nut or bolt with the fixed jaw, the jaw stem wedges in the slot to fix the movable jaw in an extended position gripping the hex shape, and enable wrenching force to be exerted on the nut or bolt.

Upon rotation of the wrenching body in the opposite direction tending to push the hex shape contour with the movable jaw, the movable jaw is free to retract into the slot, allowing the jaws to open sufficiently to clear the hex shape and thereby enable the wrench to be rotated back for the next advancing rotation of the wrench body.

The arcuate slot segment has a center of the radius of curvatures of the concentric inner and outer walls lying well within and preferably substantially centered in the quadrant of the wrenching space closest the movable jaw, which geometry has been discovered will establish an extremely smooth action. Slight adjustments in the radius center location can be made to vary the action to increase the ease of unlocking or for a tighter grip for pipe wrenches.

The slot is formed into one side of the wrench body, with a cover plate welded so as to bridge the slot and create a strong boxed structure able to resist the forces exerted by the jaw stem on the walls defining the slot during wrenching.

The spring preferably takes the form of a transverse coil spring having a pair of oppositely extending arms, one mounted to the end of the movable jaw stem and the other anchored to the wrench body. The coil is free to shift within a recess during compression and extension thereof as the stem moves in and out of the slot. The application of the spring force is generally in a direction opposed to the reaction force applied to the jaw face by the nut, which has been found to reduce the tendency of the movable jaw to wedge in the slot during ratcheting rotating.

The jaw faces are preferably formed with central vee notches to enable alternate engagement with hex flats and hex points on standard bolt heads and nuts as wrenching proceeds allowing a twelve increment ratcheting with hex shapes.

One side of the each of the vee notches are more shallowly inclined from the jaw face on the side engaged during ratcheting to make ratcheting even easier and smoother.

The jaw faces may also be serrated to allow a ratcheting open ended pipe wrench as the spring urged movable jaw can establish a gripping action on a round body not provided with wrenching feature.

An inwardly projecting stop pin is mounted to the inside of the cover fit and into a groove on one side of the movable jaw stem to locate the stem in the fully extended position of the movable jaw. In another version, a projection on the inner end of the movable jaw engages the end of the slot in the fully extended position.

The wrench is reversed for turning a bolt or nut in either direction.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
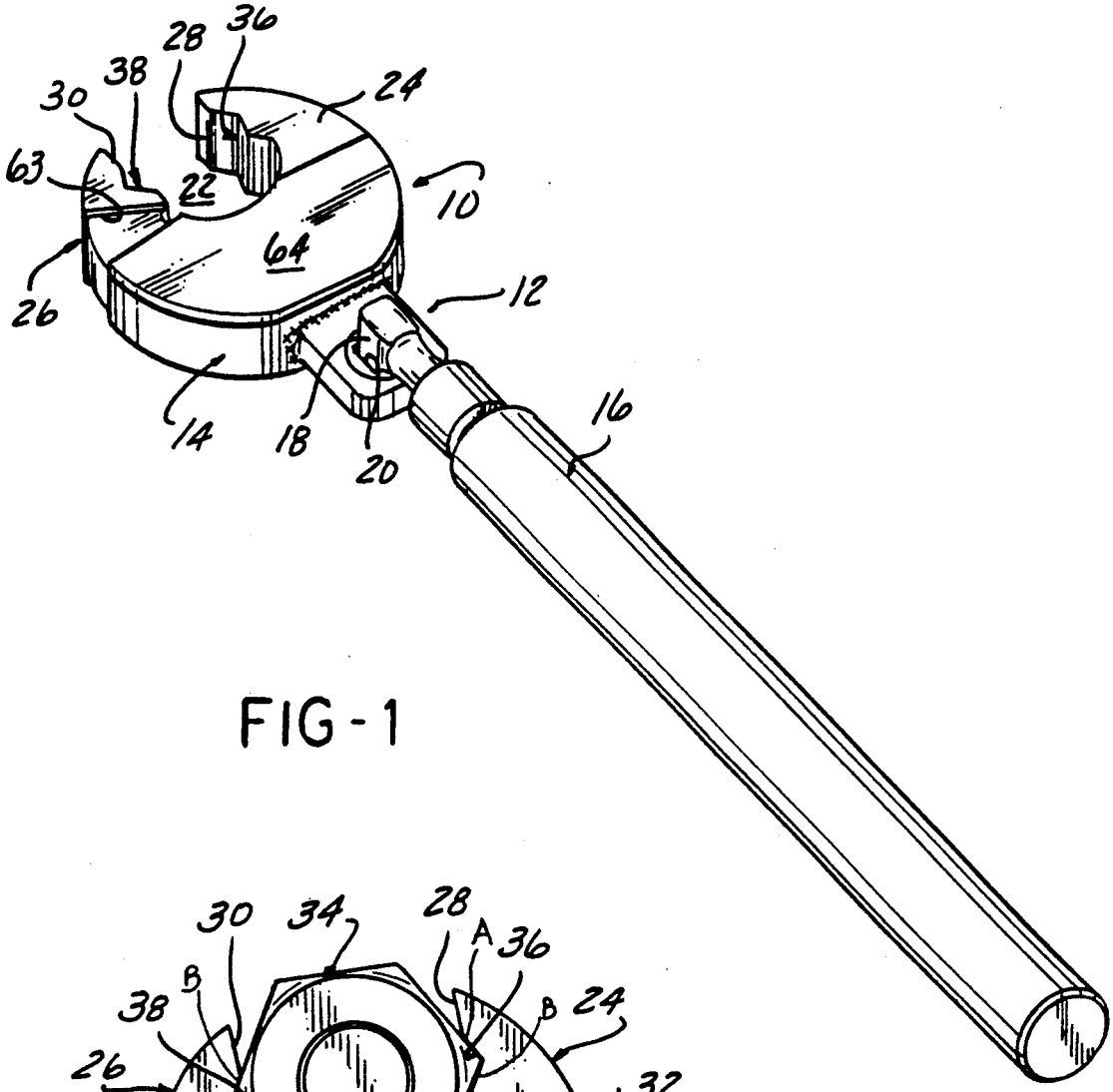
FIG. 1 is a perspective view of a ratcheting open end wrench according to the present invention with a handle installed thereon.
Figure 2:
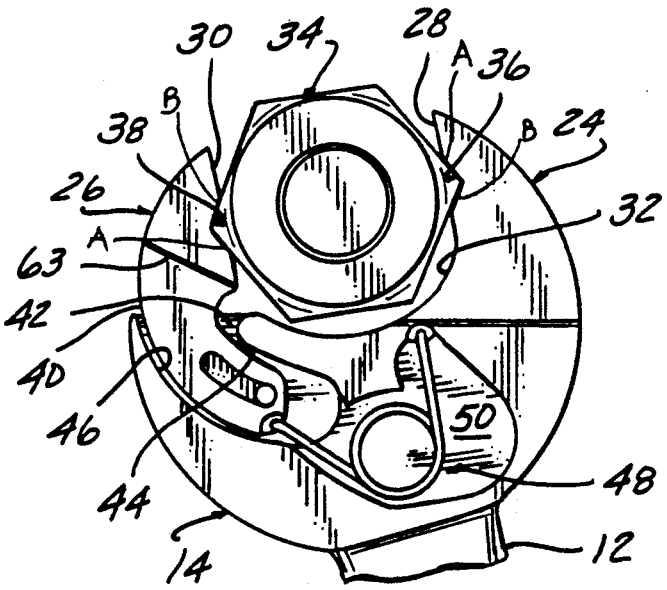
FIG. 2 is an enlarged plan view of a portion of the ratcheting wrench of FIG. 1, with the cover removed and the handle engaging tab broken away, shown with a hex head engaged by the wrench jaws as to enable wrenching in a counter clockwise direction.
Figure 3:
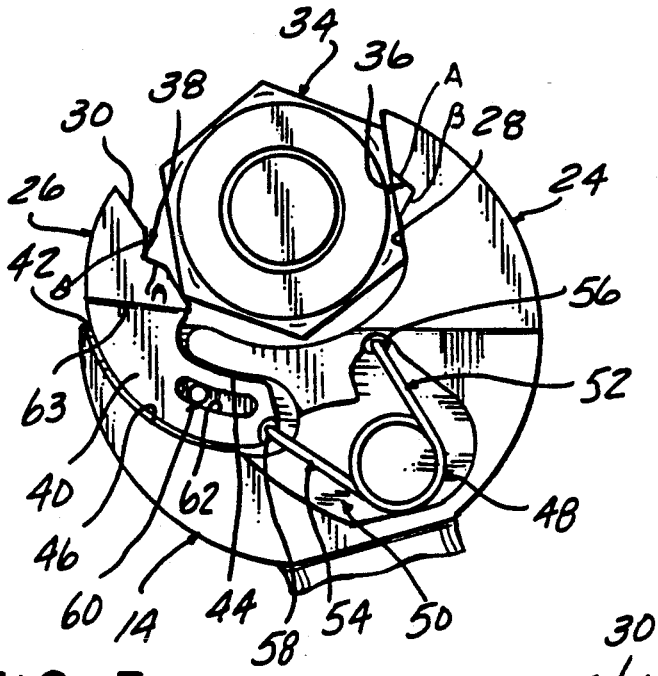
FIG. 3 is a view as in FIG. 2, with the wrench being ratcheted by a clockwise rotation and the movable jaw element partially retracted.

Referring to the Drawings, and particularly FIGS. 1-3, the ratcheting open end wrench 10 according to the present invention is shown. The wrench 10 may be formed with a handle engaged tab 12 integral with a generally planar wrench body 14, so as to enable versatile use with a separate handle 16 having a square drive 18 inserted in a square opening 20.

The wrench 10 has a wrenching space 22 lying between a fixed jaw 24 and a movable jaw 26, each projecting from the wrench body 14, with opposing spaced wrenching faces 28 and 30 on the respective jaws partially defining the wrenching space 22.

The wrenching body 14 is formed with a guide surface 32 extending between the jaw wrenching surfaces 28, 30, preferably of a radius just larger than the distance from the center of the hex shaped contour of a fastener 34 to be wrenched for which the wrench is sized, to the corners of the hex. This enables the wrench 10 to be more easily maintained in position on the fastener.

The jaw wrenching faces 28, 30 include parallel planar portions on the respective jaws 24, 26, as well as aligned vee notches 36, 38 so as to enable the jaw faces 28, 30 to successively engage the flat sides and the corners of the hex fastener 34, as shown in FIGS. 2 and 3. This allows a twelve increment ratcheting motion for standard hex shapes.

The notches 36, 38 have sides which nominally extend at a 30° angle from the jaw faces 28, 30 to form the 120° angle of a hexagon.

However, according to one aspect of the present invention, that side "A" of each notch 36, 38 which cams over the nut corners during ratcheting, is inclined slightly less, i.e., 26°-28°. This makes ratcheting even easier and smoother, such that ratcheting past only finger tight bolts is possible. FIG. 3 shows the wrench in the bolt loosening orientation, i.e., to enable wrenching in a counter clockwise direction, the wrench being reversed when tightening the bolt.

The side "B" is kept at 30° to insure good contact during wrenching engagement.

The movable jaw 26 is mounted to the wrench body 14 so as to be able to be retracted away from the extended position shown in FIG. 2. In the extended position, the movable jaw is positioned relative to the fixed jaw 24 so as to engage the hex shaped contour so as to be able to be wrenched upon rotation of the wrench body 14 in a direction towards the movable jaw, i.e., counterclockwise as viewed in FIGS. 2 and 3.

The mounting means also allows the movable jaw to be pushed by the reaction force retracting the movable jaw 26 away from the extended position upon rotation of the wrenching body 14 in a direction away from the movable jaw 26, i.e., tending to cause pushing by the movable jaw face 30, or clockwise as viewed in FIGS. 2 and 3, so that a ratcheting action is achieved.

The mounting means includes an arcuate jaw stem 40 integral with the movable jaw 26 received in an arcuate slot 42 formed into one side of the wrenching body 14 to a depth equal to almost the entire thickness of the wrenching body 14. The slot 40 extends in the generally opposite direction from that in which the movable jaw 26 projects, in a circular path such as to guide the movable jaw 26 through relative rotational travel with respect to the wrench body 14 when the rotation of the wrench body 14 tends to push the movable jaw 26 into the side or corner of the hex shaped contour of element 34.

The retraction of the movable jaw 26 causes the wrenching faces 20 30 to be separated to create sufficient clearance to allow the jaw faces 29, 30 move smoothly over the hex shaped contour of the element 34 to be wrenched, as the wrenching body 14 is rotated in that direction.

At the same time, the movable jaw 26 cannot retract when the wrenching body 14 is rotated in the opposite direction, as the reaction force acting on the movable jaw 26, causes the movable jaw to instantly wedge between the inner and outer walls 44, 46 of the slot 42.

There is preferably provided ample clearance between the jaw stem 40 and the slot walls 44, 46 to insure free motion despite the presence of dirt particles, etc.

The movable jaw 26 is urged to the extended, active position by spring means, preferably taking the form of a short coil spring 48 disposed in a recess 50 formed into the one side of the wrench body 14, which recess 50 is much shallower than the slot 40. The coil spring 48 has a pair of tangentially extending arms 52, 54, on either side of the coil, one arm 52 anchored to the wrench body 14 by a bent tip inserted in a hole 56 located at the edge of the recess 50 adjacent the wrenching space 22. The other arm 54 has a bent tip inserted in a hole 58 at the end of the jaw stem 40 remote from the jaw wrenching surface 30. Thus, as the movable jaw 26 retracts away from the extended position, the coil spring 48 is wound up more tightly to create an increasing spring force resistance, and is spring urged back to the fully extended position.

When being wound, the coil spring 48 is shifted across the recess 50 so as to continue to apply the spring force to the jaw stem 40 in a direction approximately opposed to the reaction force applied at the notch 38, having a component urging the jaw stem 40 against the far wall of slot 42. This tends to avoid an undesirable tendency for wedging of the jaw stem in the slot 42 which would otherwise occur. By use of this arrangement the spring force is also reliably generated while needing only a small space.

The movable jaw 26 can be accurately located in the extended position by a stop pin 60 disposed in an arcuate groove 62 machined or otherwise formed in one side of the jaw stem 40. The stop pin 60 is fixed to the inside of a cover piece 64 and extends inwardly into the groove 62. The groove 62 ends at the point that the jaw stem is fully extended. A ridge 63 on the movable jaw 24 at the stem 40 creates an inward stop when engaging the edge of cover piece 64.

The cover piece 64 overlies the recess 50 and slot 42, bridging the slot 42 and is welded to create a structural boxing of the slot 42. This is important to strengthen the wrench body 14 against the wedging forces tending to spread the slot walls 44, 46 during the exertion of high wrenching forces.

Figure 6:
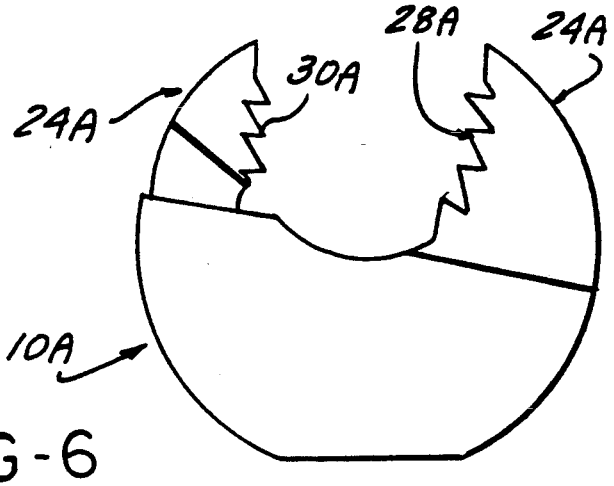
FIG. 6 is a plan view of the head of a ratcheting wrench according to the present invention with the jaws configured for use as a pipe wrench.

FIG. 6 shows an alternate embodiment wherein the wrenching face 30A of the movable jaw 24A is formed with serrations and the wrenching face 28A of the fixed jaw 24A is formed with a curved serrated configuration so that the wrench 10A is suitable for use as a pipe wrench.

Figure 4:
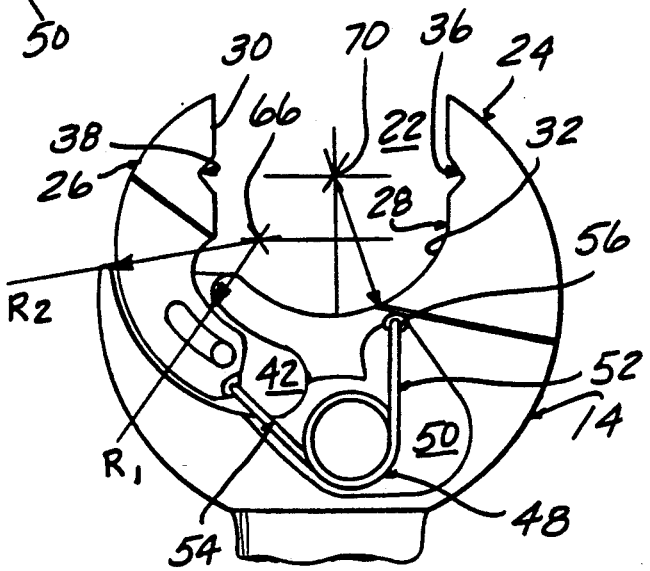
FIG. 4 is a view as in FIG. 3, with an indication of important geometrical parameters.
Figure 5:
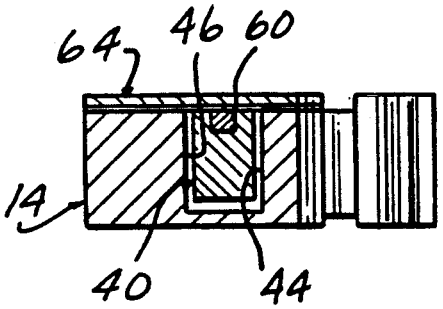
FIG. 5 is transverse sectional view through the ratcheting open end wrench showing a stop pin installed.

FIG. 4 shows in further detail the geometry of the slot 40. The slot walls 44, 46 are segments of a circular arc concentric to each other having a common center of the radius of curvature. The center of the radius of curvature 66 is approximately centrally located within a quadrant of the wrenching space 22 nearest the wrench body 14 and the movable jaw 24 such as to lie well within that quadrant. That is, at approximately one quarter of the distance between the wrenching faces 28, 30 of the jaws 24, 26 in from wrenching face 30 and one half the distance from the guide surface 32 to the line connecting the vee notches 36, 39 on the wrench body 14. That is, the center 70 of the nut or bolt 34 will be located in the space 22 on the line connecting the vee notched 36, 38. One half that distance to the guide surface 32 is the approximate correct location of radius center of curvature 66. This establishes a guided rotational movement of the movable jaw 26 as the wrench body 14 is rotated towards the movable jaw 20, which has been discovered to produce a particularly free movement away from and over the features on the element 34.

The center 66 may be shifted slightly, i.e., 10% in or out or up or down to create a greater or lesser gripping action, or a freer releasing action. The greater gripping action is desirable for the pipe wrench version 10A.

The radiuses R1, R2 of the walls 44, 46 match the radius of curvature of the jaw stem 40 to enable a smooth retraction of the removable jaw 26. The radiuses must be sized to establish sufficiently strong structure for resisting the wrenching forces. In one successfully tested design, the radius R1, equaled approximately 41% of the width of the wrenching space, i.e., the nominal wrench size, and radius R2 was equal to approximately 69% of the wrench size.

The center 70 of the radius of curvature of the guide surface 32 is located at the center of the wrenching space 22.

The spring urging of the movable jaw 24 allows the wrench 10 to be used with slightly smaller hex fasteners than the designed for size, as the wrenching action is still effective even though the movable jaw is retracted somewhat from the fully extended position. In this connection the wrench space 22 has a slightly smaller width than the hex fastener for which the wrench 10 is designed, the jaws spreading slightly by retraction of the movable jaw 26 as the wrench is fit onto the nut or bolt.

Figure 7:
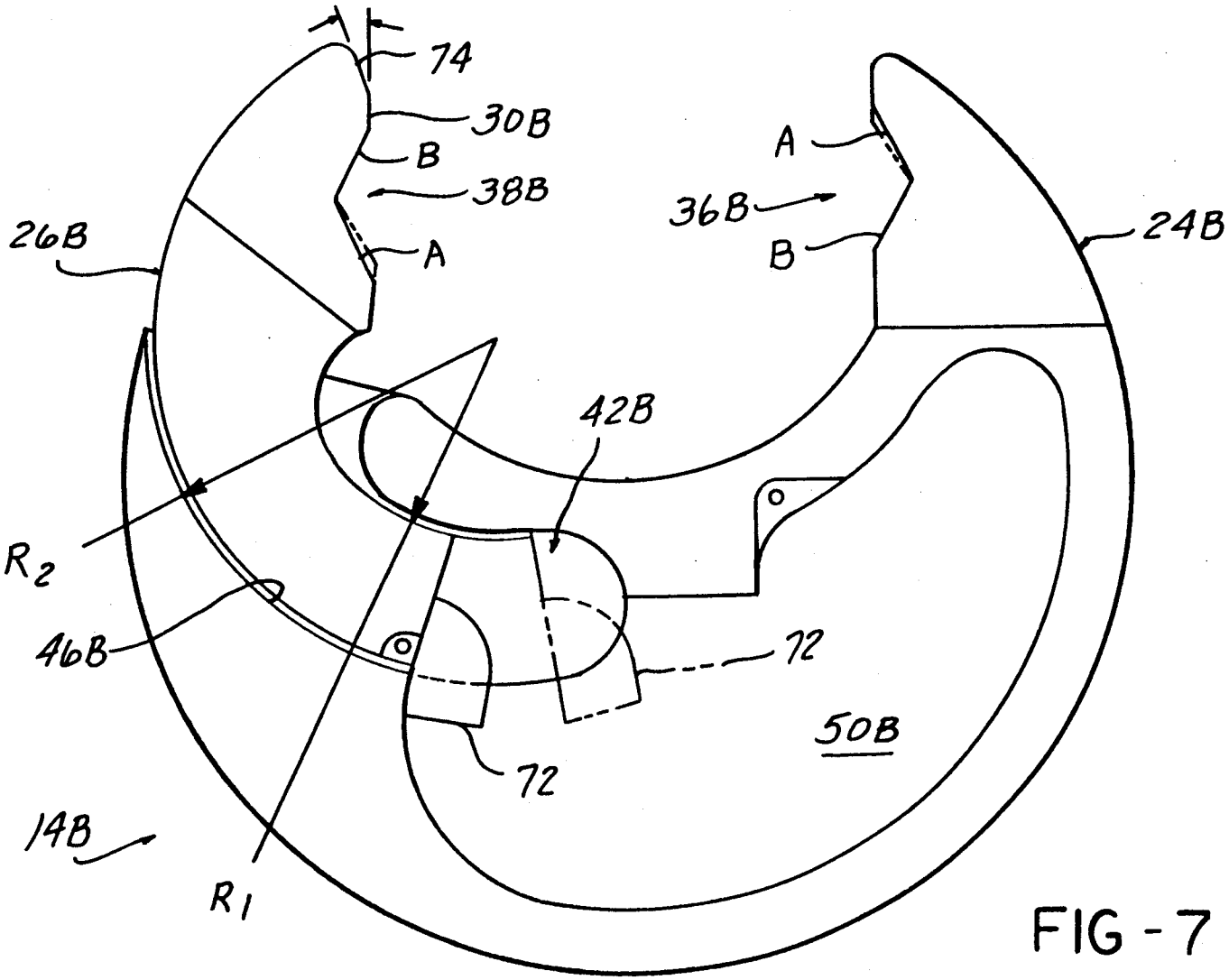
FIG. 7 is an enlarged plan view of a modified version of the movable jaw of the wrench according to the present invention, showing the vee notch geometry in further detail, and an alternate stop arrangement.

FIG. 7 is a greatly enlarged view of a modified form of the wrench, showing the geometry of the vee notches 36, 38, in which the side A engaging the bolt face during ratcheting (shown in the bolt loosening orientation) is inclined at a shallower angle with the jaw face than side B, which engages during bolt face engagement (shown in the loosening orientation).

The side A is in the range of 3°–4° shallower, i.e. 30° for side B and 26° for side A. This greatly assists the ratcheting to allow ratcheting past a nut or bolt only finger tight.

A simplified stop for the movable jaw 26B is provided by an integral projection 72 at the inside end of the movable jaw 26B. Projection 72 projects into the recess 50B and extends laterally in a direction out of the slot 42B so as to engage the wall of the recess 50B when the movable jaw 26B is fully advanced by the spring 48 (not shown in FIG. 7). This arrangement provides a simplification over the above described arrangement. The recess 50B is more extensive in this embodiment in order to lighten the weight of the wrench.

The movable jaw 26B is preferably angled outwardly, as by 15° from the face 30B at its tip 74. This also allows easier ratcheting and snapping of the jaws onto a bolt head.

Thus, a very simple, compact open end wrench has been provided which features an easy, smooth ratcheting action accomplished with a single movable jaw. The ratcheting is sufficiently easy and smooth such that the wrench can be snapped over the bolt head or nut by camming retraction of the movable jaw in any orientation of the nut or angle of the wrench as it is pushed from the side onto the nut.

I claim:

1. A ratcheting open end wrench comprising:

a wrench body;

a fixed jaw projecting from said wrench body, said fixed jaw having a wrenching face;

a movable jaw extending from said wrench body, said movable jaw having a wrenching face disposed opposite said fixed jaw wrenching face with a wrenching space therebetween configured to receive an element having a contour to be wrenched and engage the contour thereof;

means mounting said movable jaw on said wrench body so as to be freely movable from an extended position to a retracted position upon rotation of said wrench body in a direction tending to push said element to be wrenched with said movable jaw, said retraction of said movable jaw causing an increase in the width of said wrenching space enabling said wrenching face of said movable jaw to move past and over said contour of said wrenched element; and, spring means urging said movable jaw to said extended position, whereby a ratcheting action is provided with gripping by said jaw wrenching faces with rotation in one direction and free rotation in the other direction;

said means mounting said movable jaw to said wrench body including an arcuate jaw stem and an arcuate slot in said wrench body receiving said arcuate jaw stem, said jaw stem and said arcuate slot acting to guide said movable jaw to rotate upon rotation of said wrench body in a direction away from said movable jaw, to cause pushing of said movable jaw by engagement with said contour of said element to be wrenched, said arcuate stem thereby retracted into said arcuate slot, said jaw stem and slot configured to cause wedging of said jaw stem in said slot upon rotation of said wrench body in a direction towards said movable jaw to prevent retraction thereof from said extended position;

said slot formed by concentric inner and outer walls comprising arc segments having a common center of radius of curvature thereof, said center of radius lying well within a quadrant of the wrenching space closest said wrenching body and said movable jaw.

2. The wrench according to claim 1 wherein said spring means includes a wound spring having a pair of spring arms, one of said pair of spring arms engaging said jaw stem and the other of said pair of spring arms anchored to said wrench body to create a spring resistance to retraction of said jaw stem into said slot.

3. The wrench according to claim 2 wherein said wrench body has a spring mounting recess in one side thereof, said spring disposed in said recess.

4. The wrench according to claim 3 wherein said spring comprises a wound wire coil having a pair of tangential arms constituting said pair of spring arms, said coil wound up upon retraction of said jaw stem into said slot to create said spring resistance thereto, said spring applying a force generally opposite to a reaction force applied to said movable jaw wrenching face by said element to be wrenched.

5. The wrench according to claim 1 wherein said wrench body is generally planar having opposite sides separated by the thickness of said planar body and wherein said slot occupies most of the thickness thereof and is machined into one side of said wrench body to define a portion of said wrench body along either side of said slot, and further including a cover overlying said one side fixed to said portion of said wrench body along either side of said slot to strengthen said wrench body and prevent separation thereof under wrenching loads.

6. The wrench according to claim 1 wherein said common center of said radius of curvature of said slot concentric inner and outer walls is substantially centered in said quadrant of said wrenching space closest said wrenching body and said movable jaw.

7. The wrench according to claim 1 wherein said wrenching space is adapted to engage a hex shaped contour of said element to be wrenched, and wherein said wrench body is formed with a guide wall intermediate said wrenching faces of said fixed and movable jaws curved along an arc centered within said wrenching space and of a length just greater than the distance across the corners of said hex shaped contour.

8. The wrench according to claim 5 further including a stop pin inwardly extending from said cover and an arcuate groove in said jaw stem receiving said stop pin, said groove and stop pin configured and located to stop movement of said jaw stem out of said slot beyond said extended position.

9. The wrench according to claim 1 wherein said fixed and movable jaw wrenching faces are at least partially planar.

10. The wrench according to claim 1 wherein each of said jaw wrenching faces are generally planar to provide a pair of planar wrenching surfaces each planar wrenching surface formed with a vee notch aligned with each other to provide a pair of vee notches.

11. The wrench according to claim 1 wherein each of said wrenching faces are serrated, said fixed jaw serrated wrenching face extending in an arcuate shape to enable pipe wrenching.

12. The wrench according to claim 10 wherein said contour of said element to be wrenched is hex shaped, and wherein said pair element to be wrenched is hex shaped and wherein said pair of vee notches and said pair of planar wrenching faces are successively engagable with said hex shaped contour of said element to be wrenched to allow twelve increment ratcheting of said element to be wrenched.

13. The wrench according to claim 10 wherein said vee notches are each comprised of convergent sides, one side inclined to said jaw face at a predetermined angle, the other side at a slightly shallower inclination, said other side engaging said hex shaped contour of said element to be wrenched when said wrench is rotated in a ratcheting direction.

14. The wrench according to claim 13 wherein said one side of each vee notch is inclined at approximately 30° to said jaw wrenching face formed with said vee notch, and said other side of each vee notch at a shallower inclination is inclined at 26°-27° to said jaw wrenching face formed with said vee notch.

15. The wrench according to claim 13 wherein said movable jaw has a tip angled away from said jaw wrenching face.

* * * * *